US005699046A

United States Patent [19]

Accolla et al.

[11] Patent Number: 5,699,046

[45] Date of Patent: Dec. 16, 1997

[54] EAS SYSTEM EMPLOYING CENTRAL AND LOCAL STATIONS WITH SHARED FUNCTIONS

[75] Inventors: William R. Accolla, Loxahatchee; Michael A. Zampini, Boca Raton, both of Fla.

[73] Assignee: Sensormatic Electronics Corporation, Boca Raton, Fla.

[21] Appl. No.: 551,958

[22] Filed: Nov. 2, 1995

[51] Int. Cl.[6] ..... G08B 13/14

[52] U.S. Cl. ..... 340/572; 340/825.54

[58] Field of Search ..... 340/572, 825.54

[56] References Cited

U.S. PATENT DOCUMENTS

| | | | |
|---|---|---|---|
| 4,859,991 | 8/1989 | Watkins et al. | 340/572 |
| 5,214,409 | 5/1993 | Beigel | 340/572 |
| 5,235,326 | 8/1993 | Beigel et al. | 340/825.54 |
| 5,257,011 | 10/1993 | Beigel | 340/572 |
| 5,495,229 | 2/1996 | Balch et al. | 340/572 X |
| 5,499,017 | 3/1996 | Beigel | 340/572 |

OTHER PUBLICATIONS

U.S. Patent Application Serial No. 08/313848, filed Sep. 28, 1994, titled Electronic Article Surveillance Input Configuration Control System Employing Expert System Techniques For Dynamic Optimization.

*Primary Examiner*—Thomas Mullen

*Attorney, Agent, or Firm*—Robin, Blecker, Daley and Driscoll

[57] ABSTRACT

An EAS system employing a central station having a central processing unit and a local station having a microcontroller and in which the functions necessary for detecting EAS tag signals and generating alarms are shared by the central station and the local station. A switch is further provided at the local station for automatically reconfiguring the receiver antennas based on antenna configuration instructions generated at the central station responsive to certain conditions at the location being monitored.

40 Claims, 2 Drawing Sheets

PHASE AIDING CONFIGURATION

PHASE OPPOSED CONFIGURATION

EAS SYSTEM EMPLOYING CENTRAL AND LOCAL STATIONS WITH SHARED FUNCTIONS

BACKGROUND OF THE INVENTION

This invention relates to electronic article surveillance ("EAS") systems and, in particular, to EAS systems which employ a central station for system control.

In EAS systems of the above type, it is customary to provide the central station with a central processing unit which has the responsibility for performing all of the functions required to detect the presence of EAS tags and to generate alarms based thereon. The EAS tag detection function of the central processing unit is of critical importance and includes complex signal and noise processing procedures. The alarm generation function is less complex and may be characterized as a housekeeping function. This function includes the generating of alarm signals and the counting of alarms.

As EAS systems have become more sophisticated and the EAS tag detection function has increased in complexity, increasing demands have been placed on the central processing unit at the central station. This has prompted designers to look for ways to lessen these demands without degrading EAS system performance.

Also, in EAS systems of this type, when the receiver antennas are initially installed they are manually configured, i.e., connected, so as to minimize noise effects on the received signals. Thus, the receiver antennas are connected either in-phase or out-of-phase so that their received signals are either additive or subtractive. In locations where there is a great deal of electrical noise, the out-of-phase connection is used, and in locations where there is less electrical noise the in-phase connection is used.

After initial installation, a change in the electrical noise conditions at a location may warrant a change in the receiver antenna configuration, i.e., from an in-phase connection to an out-of-phase connection or vice versa. This is usually carried out by dispatching to the location a maintenance person who can then manually change the receiver antenna connections. However, since the electrical noise conditions in a location can change from hour to hour and from day to day, the availability of a maintenance person to manually change the receiver antenna configuration to accommodate these changes becomes impractical.

In U.S. patent application Ser. No. 08/313,848 assigned to the same assignee hereof, a technique is described for using a cross point switch and inversion circuits to electrically simulate reconfiguration of the receiver antennas of an EAS system. However, this requires additional circuitry and processing at the central station again increasing the demands on the central processing unit.

It is, therefore, an object of the present invention to provide an improved EAS system.

It is a further object of the present invention to provide an EAS system in which the demands placed on the central processing unit are made more manageable.

It is yet a further object of the present invention to provide an EAS system in which the receiver antennas can be readily reconfigured without a significant additional burden being placed on the central processing unit.

SUMMARY OF THE INVENTION

In accordance with the principles of the present invention, the above and other objectives are realized in an EAS system by providing a local station or means associated with the interrogation zone being monitored, by providing a central station or means which communicates with the local station, and by providing that the central station and the local station share the performance of a plurality of functions which together enable an EAS tag in the monitored interrogation location to be detected and an alarm condition generated. More particularly, in accordance with the invention, a central processing unit is included in the central station and a microcontroller is included in the local station so that the sharing of the plurality of the functions can be effected.

In one aspect of the invention, the central station using the central processing unit performs the function of processing the signals received at the local station and making a determination as to whether the received signals contain signals generated by an EAS tag. The local station using the microcontroller, in turn, performs the function of generating an alarm signal, either audible, visual or both, upon an instruction from the central processing unit that EAS tag signals are contained in the received signals. The local station can also perform certain processing functions on the received signals, e.g., amplification and selective transmission, again in conjunction with the microcontroller and before the signals are transmitted to the central station.

In a further aspect of the invention, the local station, via the microcontroller, is adapted to effect configuration of the receiver antennas associated with the local station, based on instructions from the central processing unit at the central station. More particularly, the central processing unit based on certain monitored conditions at the location provides antenna configuration instructions to the microcontroller at the local station. The microcontroller, in turn, generates antenna configuration signals which control antenna configuration switches which configure the receiver antennas so that a number of receiver antennas are connected in-phase and/or out-of-phase, depending upon the configuration signals.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
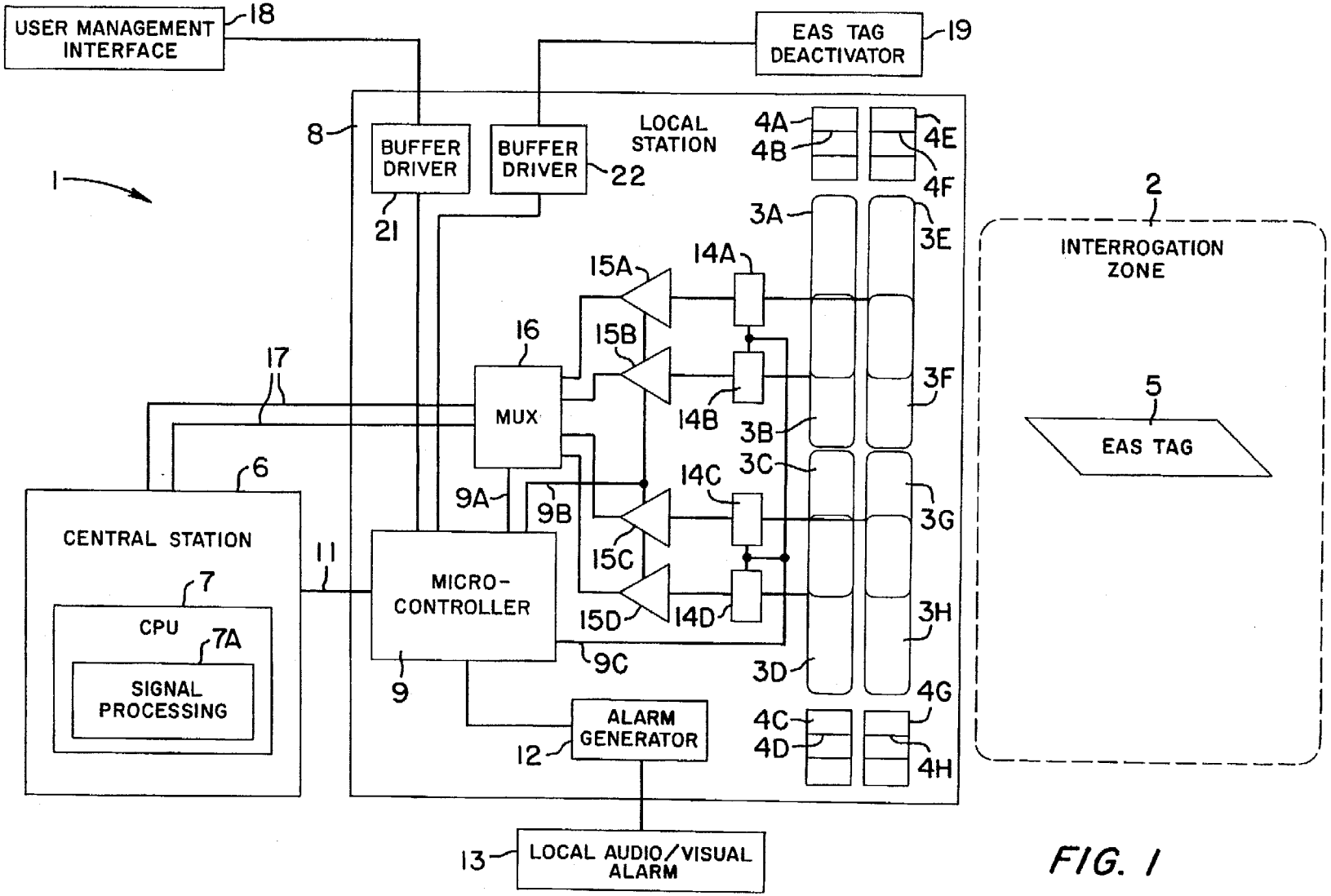
FIG. 1 shows an EAS system in accordance with the principles of the present invention.

FIG. 1 shows an EAS system 1 in accordance with the principles of the present invention. The EAS system 1 is used to monitor an interrogation zone 2. The interrogation zone 2 has associated with it four sets of receiver antennas 3A–3B, 3C–3D, 3E–3F and 3G–3H and four sets of associated transmitter antennas 4A–4B, 4C–4D, 4E–4F and 4G–4H.

The receiver antennas receive signals generated in the zone in response to signals transmitted into the zone by the transmitter antennas. If an EAS tag 5, such as, for example, a magneto-mechanical EAS tag of the type described in U.S. Pat. No. 4,510,489, is located in the zone, the received signals will contain EAS tag signals generated as a result of the interaction of the EAS tag 5 with the transmitted signals.

A central station 6 including a central processing unit 7 performs a plurality of control functions for the system 1. A primary function is a signal processing function 7A by which it processes signals received by the receiver antennas 3A–3H. Based on this processing, the central station 6 determines whether the received signals contain EAS tag signals and if EAS tag signals are found, generates an alarm condition.

In accordance with the principles of the present invention, in order to reduce the operating requirements on the central processing unit 7 which become high as the signal processing function 7A becomes more complex, the system I has been adapted to include a local station 8. More particularly, the local station 8 includes a microcontroller or microprocessor 9 which cooperates with the central processing unit 7 in the central station 6 in controlling operation of the system 1.

Specifically, in further accord with the invention, the central station 6, via the central processing unit 7, and the local station 8, via the microcontroller 9, are adapted to share the functions required to determine the presence of EAS tag signals and to generate alarm conditions and alarms in the system 1. In the present embodiment, the local station 8 and microcontroller 9 take on a variety of functions one of which is generating alarm signals, this function having previously been carried out by the central station 6 and the central processing unit 7.

More particularly, once the processing function 7A of the central processing unit 7 assesses the presence of EAS tag signals in the received signals transmitted from the local station 8, the central processing unit 7 generates an alarm instruction signal or message. This signal or message is transmitted by the central processing unit 7 to the microcontroller 9 at the local station 8 over a bidirectional serial communications path 11. The microcontroller 9, in response to the alarm instruction signal, then generates an appropriate alarm signal which it feeds to an alarm generator 12. The alarm generator 12, in turn, signals a local audio/visual alarm 13 which provides an alarm indication at the local station 8. As part of the alarm signal generation function, the microcontroller 9 also determines the specific timing for generating each alarm signal.

By using the local station 8 and the microcontroller 9 to perform the above alarm function, the burden on the central processing unit 7 and the central station 6 is reduced. Additionally, the other functions performed by the local station 8 and microcontroller 9 to be discussed hereinbelow also lessen the operating burden placed on the central processing unit 7. More particularly, the local station and microcontroller are further adapted to aid in providing signal processing and flow control of the signals received by the receiver antennas 3A–3H, as well as antenna configuration control of such antennas.

As shown in FIG. 1, the antenna pairs 3A–3B, 3C–3D, 3E–3F and 3G–3H are connected to respective antenna configuration switches 14A–14D. These switches feed the received signals from their respective antenna pairs to respective variable gain amplifiers 15A–15D. The variable gain amplifiers 15A–15D are all connected to a multiplexer 16. The multiplexer 16 selectively couples the amplified received signals from the amplifiers to an analog output line 17 which connects the local station 8 to the central station 6.

The microcontroller 9 at the local station 8 is provided with control lines 9A, 9B and 9C for controlling the multiplexer 16, amplifiers 15A–15D and antenna configuration switches 14A . 14D. Specifically, based on instruction signals generated by the central processing unit 7 at the central station 6 and conveyed to the local station 8 over the communications path 11, the microcontroller 9 controls the multiplexer 16 so that it couples a particular one of the amplifier outputs to the analog output line 17. In this way, the received signals from the antenna pairs 3A–3B, 3C–3D, 3E–3F and 3G–3H can be polled or scanned in sequence and delivered to the central station 6.

Additionally, again based on signals from the central processing unit 7 at the central station 6, the microcontroller 9 supplies suitable signals over the line 9B for adjusting the gain of the respective amplifiers 15A–15D. The received signals from the antenna pairs can thus be suitably signal processed by gain adjustment at the amplifiers 15A–15D at the local station 8 before being sent to the central station 6 for further signal processing. The central station and central processing unit 7 are thus relieved from providing these functions.

The antenna configuration function of the local station 8 and microcontroller 9 involves a further aspect of the invention in which the local station is adapted to itself permit the establishing of the configuration or connection of each pair of the receiver antennas 3A–3B, 3C–3D, 3E–3F and 3G–3H. This is accomplished via electronic configuration switches 14A–14D which are fed antenna configuration signals over the line 9C from the microcontroller 9. These configuration signals are, in turn, a result of antenna configuration instructions sent to the local station and microcontroller 9 by the central station 6 and the central processing unit 7 over the communication path 11.

Each of the antenna configuration switches 14A–14D is adapted to have two states. In a first state, the switch connects its respective pair of receiver antennas so that they are in-phase and, hence, their received signals are additive. In a second state, each switch connects its pair of receiver antennas so that they are out-of-phase and, therefore, their received signals are subtractive.

The particular configuration selected for each receiver antenna pair is based on environmental conditions at the location being monitored by the EAS system 1, including the electrical noise condition. These conditions are reported to the central station 6 and based thereon the central processing unit 7 generates antenna configuration instructions for the respective antenna configuration switches.

Each antenna configuration instruction is fed over the communication path 11 to the local station 8 and the microcontroller 9. The microcontroller 9, in turn, relays a configuration signal over the path 9C to the appropriate switch 14A to 14D. The switch thereupon takes on the respective state as determined by the signal. This, in turn, results in a change in the antenna connection, if the instruction signal indicates an antenna connection which is different from the current connection.

In this way, the receiver antenna pairs 3A–3B, 3C–3D, 3E–3F and 3G–3H at the local station 8 are automatically reconfigured. The necessity of dispatching maintenance personnel for this purpose is, thus, eliminated and the ability of the system to have receiver antenna connections best suited for the current conditions is easily and readily realized.

It should be noted that the central processing unit 7 can monitor the current conditions of the location and set the amplifier gains and the antenna configurations in various ways. Suitable procedures for doing this are disclosed in the aforementioned copending '848 patent application and in U.S. patent application Ser. No. 08/313,849, (issued as U.S. Pat. No. 5,495,229 on Feb. 27, 1996) the teachings of both of which are incorporated herein by reference.

Figure 2:
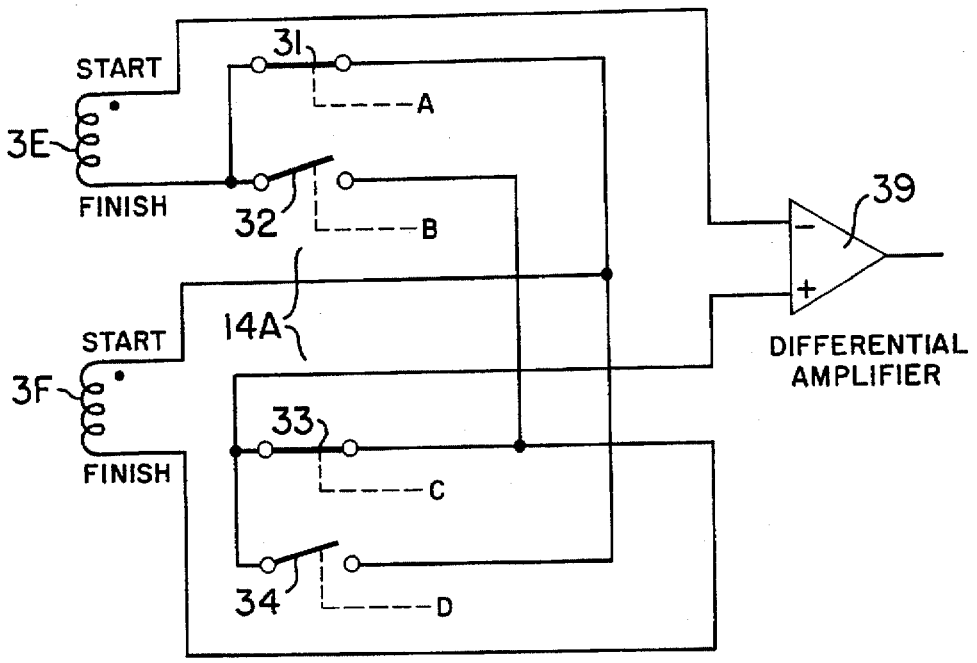
FIG. 2 shows in greater detail the receiver antenna connections for certain of the receiver antennas of FIG. 1.
Figure 2:
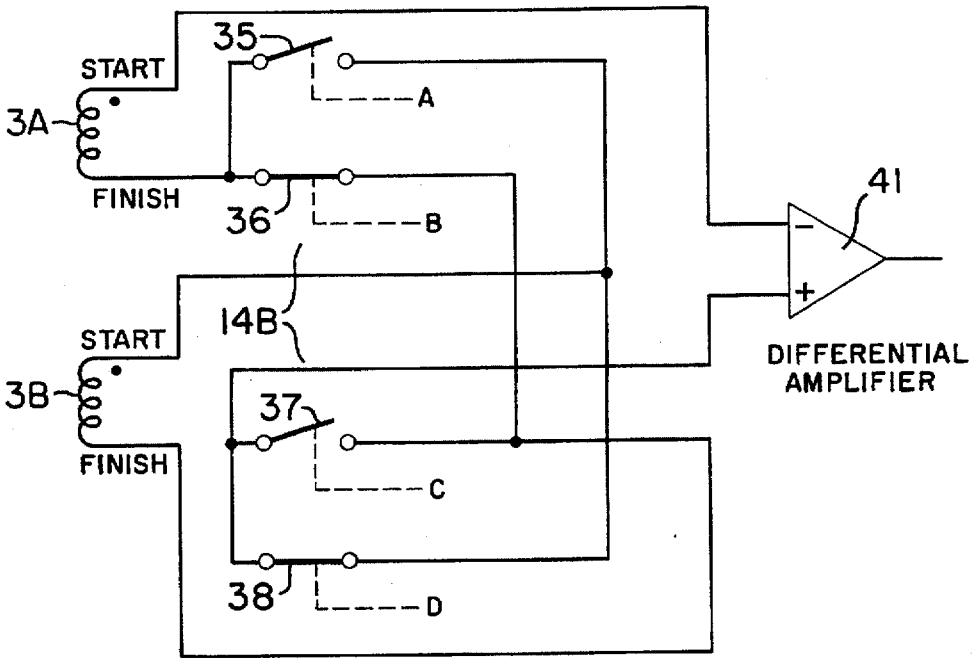

FIG. 2 shows in greater detail the antenna configuration switches 14A and 14B and the manner in which they selectively interconnect the receiver antennas pairs 3E–3F and 3A–3B. As can be appreciated, the switches 14A and 14B include eight switch contacts 31–38 connected to differential amplifiers 39 and 41. In the case shown, the contacts 31, 33, 36 and 38 are closed and the contacts 32, 34, 35 and 37 are opened. With the contacts in these states, the antennas 3E and 3F are serially connected in-phase, while the antennas 3A and 3B are serially connected out-of-phase.

By opening the contacts 31, 33, 36 and 38 and closing the contacts 32, 34, 35 and 37, the antenna configurations are changed. In these states of the contacts, the antennas 3E and 3F are serially connected out-of-phase and the antennas 3A and 3B are connected in-phase.

The antenna configuration signals from the microcontroller 9 and carried over the line 9C provide the signals A–D for controlling the contacts 31–38. Appropriate selection of the signals results in the desired contact closures and the desired antenna configurations.

As can be appreciated, in the present embodiment, each of the switches 14A–14D only permits in and out-of-phase connection of a pair of antennas. However, it is within the contemplation of the invention to provide configuration switches in which each antenna can be connected in and out-of-phase with more than one of the other antennas.

In the embodiment of the invention shown in FIG. 1, the microcontroller 9 at the local station 8 also functions to couple messages between the central processing unit 7 at the central station 6 and a management interface 18 and an EAS tag deactivator 19. This occurs through buffer drivers 21 and 22, respectively.

In this way, the microcontroller 9 can provide enable and disable signals to the EAS tag deactivator 19 based on enable and disable instructions from the central processing unit 7. The microcontroller 9 can also provide to the central processing unit 7 information as to EAS tag deactivations based on tag deactivations reported to the microcontroller by the deactivator.

The microcontroller 9 additionally can relay information as to system status events received from the central processing unit 7 to the user management interface 18 based on requests for information from the interface. Finally, signals for controlling operation of the EAS system generated at the interface 18 can be relayed by the microcontroller 9 to the central processing unit 7 for action by the unit.

In the present illustrative case, communication between the central processing unit 7 and the microcontroller 9 is by way of bi-directional serial communications paths 11. This path can also be a parallel communication path, if desired.

The microcontroller 9 can typically be a Motorola 68HC811E2 provided with the appropriate software programming to accommodate the desired shared functions to be performed by the microcontroller. The central processing unit 7 can typically be an Intel 80386/486-40 with appropriate software programming to perform its signal processing function and other functions to effect EAS signal determinations.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention. Thus, for example, the local station 8 via the microcontroller 9, can be further adapted to provide additional signal processing of the received signals such as, for example, signal conditioning, signal enhancement and preliminary signal decisions. It also could be adapted via the microcontroller to provide a part of the EAS tag signal determination function (including processing a part of the EAS tag signal determination algorithm) for the received signals.

What is claimed is:

1. An electronic article surveillance ("EAS") system for detecting EAS tags in an interrogation zone, said EAS system comprising:

a local means associated with said interrogation zone, said local means including a microcontroller and performing a function of causing interrogation signals to be transmitted into the interrogation zone and a function of causing signals to be received from the interrogation zone;

a central means communicating with said local means, said central means including a central processing unit; and said local means, using said microcontroller, and said central means, using said central processing unit, sharing the performance of a plurality of functions which together enable an EAS tag in said interrogation zone to be detected and an alarm condition generated, the plurality of functions whose performance is shared by said central means and said local means including signal processing functions by which the signals received by said local means are processed.

2. An EAS system is accordance with claim 1 wherein:

said local means performs one or more of the following signal processing functions on the signals received by said local means: variable signal amplification, signal selection, signal combining, signal subtracting, signal conditioning, signal enhancement and/or signal decisions; and said central means performs at least the following signal processing function on the signals received by said local means and transmitted by said local means to said central means: processing to determine whether the received signals contain EAS tag signals.

3. An EAS system in accordance with claim 2 wherein:

said local means includes: at least one variable gain amplifier for amplifying a received signal;

and said microcontroller provides signals to said variable gain amplifier for setting the gain of said variable gain amplifier.

4. An EAS system in accordance with claim 2 wherein:

said local means includes: a multiplexer for receiving a plurality of received signals and selectively outputting a particular one of said received signals for transmission to said central means;

and said microcontroller provides signals to said multiplexer for instructing said multiplexer as to which one of said plurality of received signals should be output by said multiplexer.

5. An EAS system in accordance with claim 2 wherein:

said central means performs the further function of reporting to said local means when said central means determines that EAS tag signals are contained in the signals received by said local means and transmitted by said local means to said central means; and said local means in response to receiving a report that the signals received by said local means contain EAS tag signals performs the function of generating an alarm signal.

6. An EAS system in accordance with claim 5 wherein:
the alarm signal generated at said local means results in one or more of an audible alarm and a visual alarm.

7. An EAS system in accordance with claim 5 wherein:
said local means includes an alarm assembly;
and said microcontroller generates said alarm signal for feeding to said alarm assembly.

8. An EAS system in accordance with claim 1 wherein:
said local means performs the function of generating an alarm signal when a determination is made that an EAS tag is in said interrogation zone.

9. An EAS system in accordance with claim 8 wherein:
the alarm signal generated at said local means causes one or more of an audible alarm and a visual alarm.

10. An EAS system in accordance with claim 8 wherein:
said local means includes an alarm assembly;
and said microcontroller generates said alarm signal for feeding to said alarm assembly.

11. An EAS system in accordance with claim 1 further comprising:
a bi-directional communications path connecting the central processing unit to said microcontroller.

12. An EAS system in accordance with claim 11 in which:
said bi-directional communications path is one of a serial and parallel bi-directional communications path.

13. An electronic article surveillance ("EAS") system for detecting EAS tags in an interrogation zone, said EAS system comprising:
a local means associated with said interrogation zone, said local means including a microcontroller and performing a function of causing interrogation signals to be transmitted into the interrogation zone and a function of causing signals to be received from the interrogation zone;
a central means communicating with said local means, said central means including a central processing unit;
said local means, using said microcontroller, and said central means, using said central processing unit, sharing the performance of a plurality of functions which together enable an EAS tag in said interrogation zone to be detected and an alarm condition generated;
said central means performing the function of reporting to said local means when said central means determines that EAS tag signals are contained in the signals received by said local means and transmitted by said local means to said central means; and
said local means in response to receiving a report that the signals received by said local means contain EAS tag signals performs the function of generating an alarm signal.

14. An EAS system in accordance with claim 13 wherein:
the alarm signal generated at said local means results in one or more of an audible alarm and a visual alarm.

15. An EAS system in accordance with claim 13 wherein:
said local means includes an alarm assembly;
and said microcontroller generates said alarm signal for feeding to said alarm assembly.

16. An electronic article surveillance ("EAS") system for detecting EAS tags in an interrogation zone, said EAS system comprising:
a local means associated with said interrogation zone, said local means including a microcontroller and performing a function of causing interrogation signals to be transmitted into the interrogation zone and a function of causing signals to be received from the interrogation zone;
a central means communicating with said local means, said central means including a central processing unit;
said local means, using said microcontroller, and said central means, using said central processing unit, sharing the performance of a plurality of functions which together enable an EAS tag in said interrogation zone to be detected and an alarm condition generated;
said local means performing in one of a plurality of diverse manners the function of causing signals to be received from the interrogation zone;
and said central means responsive to one or more conditions performing a function of instructing said local means to receive signals from the interrogation zone in a particular one of said plurality of diverse manners.

17. An EAS system in accordance with claim 16 wherein:
said one or more conditions include an electrical noise condition.

18. An EAS system in accordance with claim 16 wherein:
said local means includes: a plurality of receiving antennas; and switch means having a plurality of states in which said switch means configures a number of said plurality of receiving antennas to be connected in-phase and/or out-of-phase;
and said central means responsive to said one or more conditions functions to instruct said switch means to be in one of said plurality of states of said switch means.

19. An EAS system in accordance with claim 18 wherein:
said central processing unit generates an antenna configuration instruction corresponding to said one of said plurality of states of said switch means;
and said microcontroller receives said antenna configuration instruction and generates an antenna configuration signal which said microcontroller transmits to said switch means to cause said switch means to take on said one of said plurality of states.

20. An electronic article surveillance ("EAS") system for detecting EAS tags in an interrogation zone, said EAS system comprising:
a local means associated with said interrogation zone, said local means including a microcontroller;
a central means communicating with said local means, said central means including a central processing unit;
said local means, using said microcontroller, and said central means, using said central processing unit, sharing the performance of a plurality of functions which together enable an EAS tag in said interrogation zone to be detected and an alarm condition generated;
said local means performing the function of generating an alarm signal when a determination is made that an EAS tag is in said interrogation zone; and
said central means performing the function of reporting to said local means that a determination has been made that an EAS tag is in the interrogation zone.

21. An electronic article surveillance ("EAS") system for detecting EAS tags in an interrogation zone, said EAS system comprising:
a local means associated with said interrogation zone, said local means including a microcontroller and a selectively reconfigurable antenna means;
a central means communicating with said local means, said central means including a central processing unit and performing the function of instructing said local means to select a particular one of the configurations of the reconfigurable antenna means of said local means; and said local means, using said microcontroller, and said central means, using said central processing unit, sharing the performance of a plurality of functions which together enable an EAS tag in said interrogation zone to be detected and an alarm condition generated.

22. An EAS system in accordance with claim 21 wherein:

said reconfigurable antenna means is a receiver antenna means.

23. An EAS system in accordance with claim 21 wherein:

said central means performs the function of instructing said local means in response to an electrical noise condition.

24. An EAS system in accordance with claim 21 wherein:

the reconfigurable antenna means of said local means includes a plurality of receiver antennas configurable in a plurality of different configurations in which a number of said plurality of receiver antennas are connected in-phase and/or out-of-phase.

25. An EAS system in accordance with claim 24 wherein:

said central processing unit generates an antenna configuration instruction corresponding to one of said plurality of different configurations;

and said microcontroller receives said antenna configuration instruction and generates an antenna configuration signal which said microcontroller transmits to said reconfigurable antenna means to cause said reconfigurable antenna means to have said one of said plurality of different configurations.

26. An electronic article surveillance ("EAS") system for detecting EAS tags in an interrogation zone, said EAS system comprising:

a local means associated with said interrogation zone, said local means including a microcontroller;

a central means communicating with said local means, said central means including a central processing unit;

said local means, using said microcontroller, and said central means, using said central processing unit, sharing the performance of a plurality of functions which together enable an EAS tag in said interrogation zone to be detected and an alarm condition generated;

an EAS tag deactivator means associated with said local means for deactivating EAS tags;

and said microcontroller at said local means providing signals to and receiving signals from said EAS tag deactivator.

27. An EAS system in accordance with claim 26 wherein:

said microcontroller provides signals to said EAS tag deactivator in response to signals from said central processing unit;

and said microcontroller provides signals to said central processing unit based on said signals received from said EAS tag deactivator.

28. An electronic article surveillance ("EAS") system for detecting EAS tags in an interrogation zone, said EAS system comprising:

a local means associated with said interrogation zone, said local means including a microcontroller;

a central means communicating with said local means, said central means including a central processing unit;

said local means, using said microcontroller, and said central means, using said central processing unit, sharing the performance of a plurality of functions which together enable an EAS tag in said interrogation zone to be detected and an alarm condition generated;

a user management interface associated with said local means;

and said microcontroller providing signals to and receiving signals from said user management interface.

29. An EAS system in accordance with claim 28 wherein:

said microcontroller provides signals to said user management interface in response to signals received from said central processing unit; and said microcontroller provides signals to said central processing unit in response to signals from said user management interface.

30. A local station for use in an EAS system for detecting EAS tags in an interrogation zone, said EAS system including a central station communicating with said local station and having a central processing unit, said local station being associated with said interrogation zone and comprising:

a communication port for receiving signals from and transmitting signals to the central processing unit of said central station;

a microcontroller for communicating with said central processing unit through said communication port and for performing one or more functions associated with enabling an EAS tag in said interrogation zone to be detected and an alarm condition generated;

first means for causing interrogation signals to be transmitted into said interrogation zone and signals to be received from said interrogation zone, said first means including processing means for processing signals caused to be received by said first means;

said processing means including: at least one variable gain amplifier for amplifying a received signal;

and said microcontroller providing signals to said variable gain amplifier for setting the gain of said variable gain amplifier.

31. A local station for use in an EAS system for detecting EAS tags in an interrogation zone, said EAS system including a central station communicating with said local station and having a central processing unit, said local station being associated with said interrogation zone and comprising:

a communication port for receiving signals from and transmitting signals to the central processing unit of said central station;

a microcontroller for communicating with said central processing unit through said communication port and for performing one or more functions associated with enabling an EAS tag in said interrogation zone to be detected and an alarm condition generated;

first means for causing interrogation signals to be transmitted into said interrogation zone and signals to be received from said interrogation zone; said first means including processing means for processing signals caused to be received by said first means;

said processing means including: a multiplexer for receiving a plurality of received signals and selectively outputting a particular one of said received signals for transmission to said central station;

and said microcontroller providing signals to said multiplexer for instructing said multiplexer as to which one of said plurality of received signals should be output by said multiplexer.

32. A local station for use in an EAS system for detecting EAS tags in an interrogation zone, said EAS system including a central station communicating with said local station and having a central processing unit, said local station being associated with said interrogation zone and comprising:

a communication port for receiving signals from and transmitting signals to the central processing unit of said central station;

a microcontroller for communicating with said central processing unit through said communication port and for performing one or more functions associated with enabling an EAS tag in said interrogation zone to be detected and an alarm condition generated;

first means for causing interrogation signals to be transmitted into said interrogation zone and signals to be received from said interrogation zone, said first means including a selectively reconfigurable antenna means;

and said microcontroller in response to an antenna configuration instruction from said central processing unit providing an antenna configuration signal to said selectively reconfigurable antenna means to cause said selectively reconfigurable antenna means to take on a particular antenna configuration.

33. A local station in accordance with claim 32 wherein:

said selectively reconfigurable antenna means includes a plurality of receiver antennas configurable in a plurality of different antenna configurations in which a number of said plurality of receiver antennas are connected in-phase and/or out-of-phase.

34. A local station in accordance with claim 32 wherein:

said selectively reconfigurable antenna means includes: a plurality of receiver antennas; and switch means having a plurality of states in which said switch means configures a number of said plurality of receiver antennas to be connected in-phase and/or out-of-phase; and said microcontroller in response to said antenna configuration instruction from said central processing unit provides said antenna configuration signal to said switch means to cause said switch means to be in the one of said plurality of states corresponding to said particular antenna configuration.

35. A local station for use in an EAS system for detecting EAS tags in an interrogation zone, said EAS system including a central station communicating with said local station and having a central processing unit, said local station being associated with said interrogation zone and comprising:

a communication port for receiving signals from and transmitting signals to the central processing unit of said central station;

a microcontroller for communicating with said central processing unit through said communication port and for performing one or more functions associated with enabling an EAS tag in said interrogation zone to be detected and an alarm condition generated; and said microcontroller in response to a signal from said central processing unit that an EAS tag is present in said interrogation zone generating an alarm signal.

36. A local station in accordance with claim 35 wherein:

said local station further comprises an alarm assembly;

and said microcontroller couples said alarm signal to said alarm assembly.

37. A local station for use in an EAS system for detecting EAS tags in an interrogation zone, said EAS system including a central station communicating with said local station and having a central processing unit, said local station being associated with said interrogation zone and for further use with an EAS tag deactivator associated with that local station for deactivating EAS tags, said local station comprising:

a communication port for receiving signals from and transmitting signals to the central processing unit of said central station;

a microcontroller for communicating with said central processing unit through said communication port and for performing one or more functions associated with enabling an EAS tag in said interrogation zone to be detected and an alarm condition generated; and said microcontroller providing signals to and receiving signals from said EAS tag deactivator.

38. A local station in accordance with claim 37 wherein:

said microcontroller provides signals to said EAS tag deactivator in response to signals from said central processing unit;

and said microcontroller provides signals to said central processing unit based on said signals received from said EAS tag deactivator.

39. A local station for use in an EAS system for detecting EAS tags in an interrogation zone, said EAS system including a central station communicating with said local station and having a central processing unit, said local station being associated with said interrogation zone and for further use with a user management interface associated with the local station for controlling the EAS system and receiving information as to EAS system status events, said local station comprising:

a communication port for receiving signals from and transmitting signals to the central processing unit of said central station; and a microcontroller for communicating with said central processing unit through said communication port and for performing one or more functions associated with enabling an EAS tag in said interrogation zone to be detected and an alarm condition generated.

said microcontroller providing signals to and receiving signals from said user management interface.

40. A local station in accordance with claim 39 wherein:

said microcontroller provides signals to said user management interface in response to signals received from said central processing unit; and said microcontroller provides signals to said central processing unit in response to signals from said user management interface.

* * * * *

UNITED STATES PATENT AND TRADEMARK OFFICE

CERTIFICATE OF CORRECTION

PATENT NO. : 5,699,046

DATED : December 16, 1997

INVENTOR(S) : Accolla et al.

It is certified that error appears in the above-identified patent and that said Letters Patent is hereby corrected as shown below:

Col. 3, line 10, delete "system I" and insert – system 1 –.

Col. 3, line 65, delete "14A . 14D" and insert – 14A-14D –.

Signed and Sealed this

Fifth Day of May, 1998

*Attest:*

*Attesting Officer*

BRUCE LEHMAN

*Commissioner of Patents and Trademarks*